US005197905A

United States Patent [19]

Tröschel

[11] Patent Number: 5,197,905

[45] Date of Patent: Mar. 30, 1993

[54] CONTACT SLEEVE FOR A MEASUREMENT MOVEMENT

[75] Inventor: Bernard Tröschel, Oberursel, Fed. Rep. of Germany

[73] Assignee: VDO Adolf Schindling AG, Frankfurt am Main, Fed. Rep. of Germany

[21] Appl. No.: 781,754

[22] Filed: Oct. 23, 1991

[30] Foreign Application Priority Data

Dec. 12, 1990 [DE] Fed. Rep. of Germany ..... 4039625

[51] Int. Cl.[5] ..... H01R 13/42

[52] U.S. Cl. ..... 439/737

[58] Field of Search ..... 435/78, 737-739; 411/61, 437, 182, 512, 525-527, 918

[56] References Cited

U.S. PATENT DOCUMENTS 2,156,003 4/1939 Tinnerman ..... 411/918 X 3,283,639 11/1966 Holton ..... 411/437

FOREIGN PATENT DOCUMENTS 6408852 2/1965 Netherlands ..... 411/437

*Primary Examiner*—Eugene F. Desmond

*Attorney, Agent, or Firm*—Martin A. Farber

[57] ABSTRACT

A contact sleeve (6) for installation of a measurement movement to a printed circuit board is produced from sheet metal by rolling. The sleeve has inwardly directed projections which can be produced, for instance, by a flanging (14), and which have the function of a thread so that an attachment screw, which at the same time accomplishes an electrical contacting to the circuit board, can be screwed into the contact sleeve (6). As twist-preventing means (15), a sheet-metal lug (17) is bent obliquely outward out of the outer surface of the contact sleeve (6). Other embodiments of twist-prevention means in the form of indentations are disclosed.

14 Claims, 4 Drawing Sheets

Fig.3
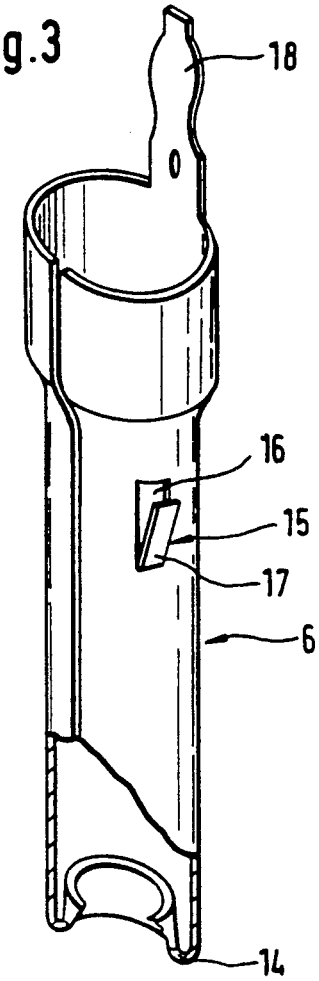
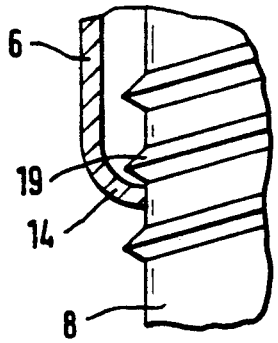
Fig.4
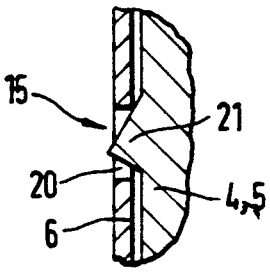
Fig.5
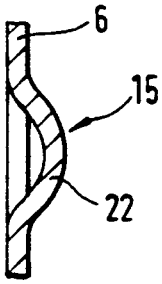
Fig.6
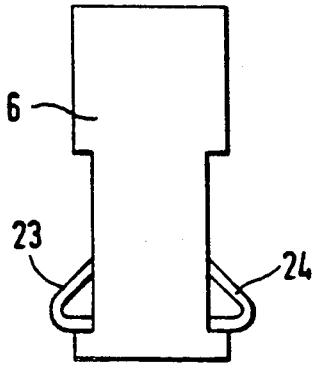
Fig.7
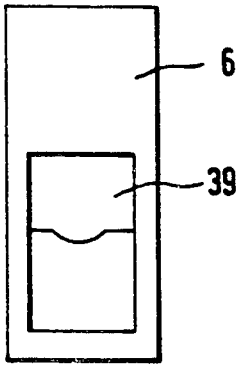
Fig.8
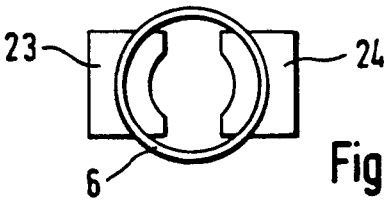
Fig.9
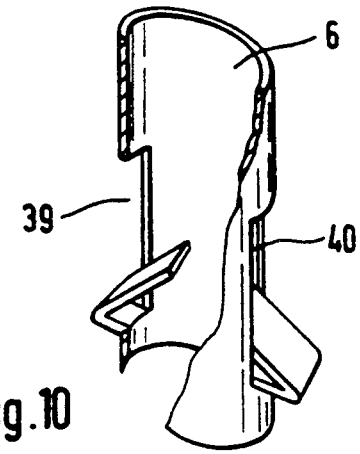
Fig.10

CONTACT SLEEVE FOR A MEASUREMENT MOVEMENT

FIELD AND BACKGROUND OF THE INVENTION

The present invention relates to a contact sleeve for installation of a measurement movement, in particular for a rotary-magnet ratio measurement movement, to a support element such as a printed circuit board and, wherein, the contact sleeve is developed for the screwing-in of an attachment screw which simultaneously produces an electrical contacting.

Contact sleeves of this type are customarily located in coil formers of such measurement movements in order to attach the measurement movement to a printed circuit board by means of the attachment screws, and at the same time to effect a contacting by means of the attachment screws. In the known measurement movements the contact sleeves are developed as bushings produced by lathe-turning, and having an internal thread. Such contact sleeves make possible the dependable attachment of the measurement movement on the printed circuit board and at the same time the electrical contacting, or connection of the winding of the measurement movement to the circuit board. However, the sleeves are relatively expensive to manufacture. Since measurement movements having such contact sleeves are manufactured in very large numbers, for instance, for motor vehicles, savings in cost of manufacture are of great financial importance.

SUMMARY OF THE INVENTION

It is an object of the present invention so to develop a contact sleeve of the above-indicated type that it is of the simplest possible construction but can still serve without change for attaching and contacting measurement movements.

According to the invention, the contact sleeve (e.g., 6, 7) is developed as a sheet-metal part rolled into a cylinder which has at least one inwardly directed projection (11, 12, 13) for engagement into the thread (19) of the attachment screw (8) and at least one twist-preventing means (15) which is formed by an outwardly directed projection (e.g., sheet-metal lug (17) or an opening (20).

As a result of this development, the contact sleeve is of extremely simple construction without its two functions of attaching and contacting the measurement movement being restricted thereby. As a result of the invention, as a whole, a substantial reduction in the cost of manufacturing measurement movements can be achieved.

The attachment screw can exert relatively high axial clamping forces if, in accordance with one advantageous development of the invention, the inwardly directed projection is formed by an obliquely extending beading 14 corresponding to the pitch of the thread of the attachment screw (8), of an oblique end edge of the contact sleeve (6, 7).

The twist-preventing means of the contact sleeve is of particularly simple development if, in accordance with one feature of the invention, the outwardly directed projection serves as twist-preventing means (15) and is formed by a cut (16) in the sheet-metal part and a sheet-metal lug (17) which is bent outwardly out of the contour of the sheet-metal part.

The mounting of the contact sleeve is possible by simple insertion into a hole in the coil former and twist-proof engagement in the proper position, if the sheet-metal lug is developed as detent (22).

An inwardly directed projection and a projection forming the twist-preventing means can be produced by a single structural part in particularly cost-favorable manner if the inwardly directed projection and the twist-preventing means are formed of a single sheet-metal lug (23, 24) which is first bent outward out of the contour of the sheet-metal part and then bent back inward again beyond the inner contour of the sheet-metal part.

The inwardly directed projections which assume the function of a thread are developed in particularly cost-favorable manner, if a total of two sheet-metal lugs (23, 24) are provided on opposite sides, staggered in height corresponding to the pitch of the thread of the attachment screw (8).

An alternative, also cost-favorable development of the inwardly directed projection is formed of a circumferential indentation (25) which extends obliquely corresponding to the pitch of the thread of the attachment screw (8).

It is even more favorable from a cost standpoint if the inwardly directed projection is formed of two tangential indentations (26, 27) which are staggered in height corresponding to the pitch of the thread of the attachment screw (8).

Another very simple embodiment is attained by the inwardly directed projection being formed of a sheet-metal tongue (30, 31) which is produced by a U-shaped cut (29) and bent obliquely into the contour of the sheet-metal part.

It may be advantageous from the standpoint of manufacturing technique if the inwardly directed projection is in each case formed by a point-shaped indentation (35–38).

A further feature of the invention provides that an inwardly directed projection is formed in each case by an elongated indentation; this is advantageous for the transmission of higher axial forces.

The outwardly directed projections which serve as twist-preventing means can also be developed as outwardly directed indentations (32–34) of the sheet-metal part.

The outwardly directed projections (e.g., the indentations 32–34) can also be elongated along the direction of screw thread in accordance with one advantageous development of the invention.

BRIEF DESCRIPTION OF THE DRAWINGS

With the above and other objects and advantages in view, the present invention will become more clearly understood in connection with the detailed description of preferred embodiments, when considered with the accompanying drawings, of which:

FIG. 3 is a perspective view of one embodiment of a contact sleeve;

FIG. 4 shows an engagement region of the attachment screw in the contact sleeve;

FIG. 5 is another embodiment of a twist-preventing means;

FIG. 6 is a twist-preventing means developed as detent;

FIG. 7 is a partial view of another embodiment of a contact sleeve;

FIG. 8 is a side view of the contact sleeve of FIG. 7;

FIG. 9 is a top view of the contact sleeve according to FIGS. 7 and 8;

FIG. 10 is a perspective view of the contact sleeve, partially cut away;

DETAILED DESCRIPTION OF THE PREFERRED EMBODIMENTS

Figure 1:
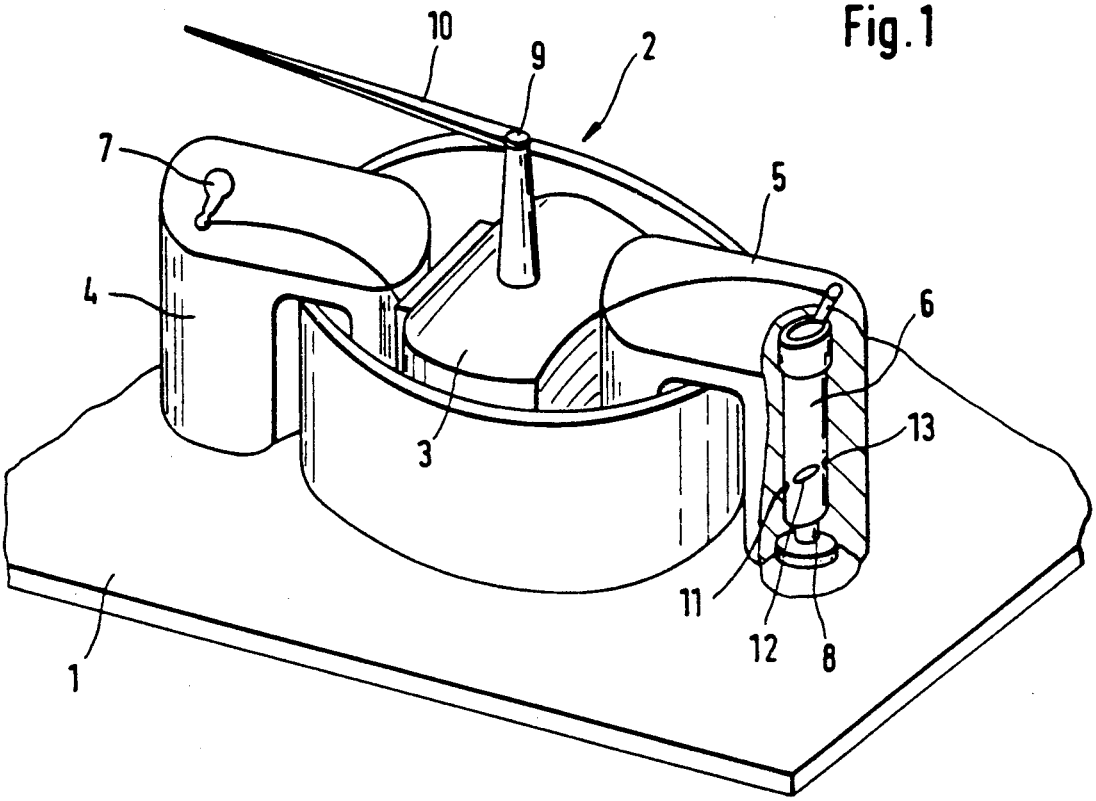
FIG. 1 is a perspective view of a measurement movement having the contact sleeves of the invention.

FIG. 1 shows a printed circuit board 1 on which a measurement movement 2, developed as rotary-magnet ratio measurement movement, is fastened.

This measurement movement 2 has a coil former 3 with lateral screw-attachment arms 4, 5 in each of which a contact sleeve 7, 6 is arranged. As shown in the case of the contact sleeve 6, an attachment screw 8 is screwed into each contact sleeve 6, 7 from the side of the printed circuit board 1 away from the measurement movement 2. In this way, the measurement movement 2 is held on the printed circuit board 1 and at the same time contacted.

FIG. 1, furthermore, shows a pointer shaft 9 on which a pointer 10 is arranged. A dial face bearing the scale of the measuring instrument formed by the measurement movement 2 is not shown.

Figure 2:
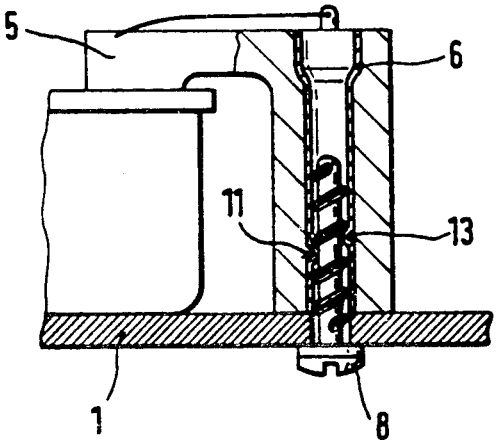
FIG. 2 is a section through the measurement movement in the region of a contact sleeve.

It is of the essence for the invention that the contact sleeve 6 consist of thin sheet metal produced by rolling. In the outer surface of the contact sleeve 6, inwardly directed projections 11, 12, 13 are arranged in such a manner that they can perform the function of a screw thread so that the attachment screw 8 can, in this way, be screwed into the contact sleeve 6. The sectional view of FIG. 2 makes these relationships clear.

FIG. 3 shows that the inwardly directed projections can also be formed by a flanging 14 of an obliquely extending end edge of the contact sleeve 6. FIG. 3 furthermore shows a twist-preventing means 15 which is formed by a U-shaped cut 16 and a sheet-metal lug 17 which is bent obliquely out of the contour of the contact sleeve 6. FIG. 3, furthermore, shows a contact tab 18 provided on the contact sleeve 6.

FIG. 4 shows how a screw thread 19 of the screw 8 engages over the flanging 14 and can in this way be screwed into and held fast in the contact sleeve 6.

FIG. 5 shows that the twist-preventing means 15 can also be formed of an opening 20 in the contact sleeve 6 into which opening a projection 21 of the attachment part 4 or 5 engages.

In accordance with FIG. 6 the twist-preventing means 15 is developed as arcuate detent 22 which can engage into a recess (not shown) when the contact sleeve is inserted into the attachment arm 4 or 5.

In the embodiment according to FIGS. 7 to 10 there are provided as outwardly and simultaneously inwardly directed projections two sheet-metal lugs 23, 24 which are arranged opposite each other and which, as can be noted particularly clearly from FIG. 10, extend in each case first out of the contour of the contact sleeve 6 and then back into it again. In order to be able to form the sheet-metal lugs 23, 24, two window-like recesses 39, 40 are provided in the outer surface of the contact sleeve 6.

Figure 11:
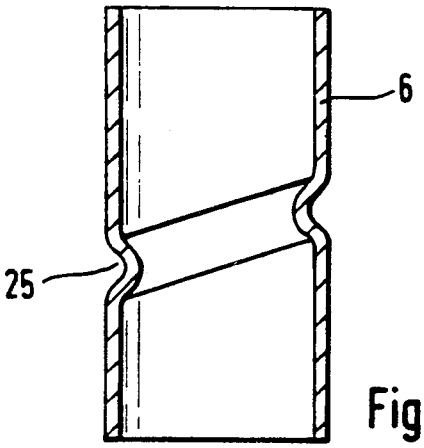
FIG. 11 is a longitudinal section through another embodiment of a contact sleeve.
Figure 13:
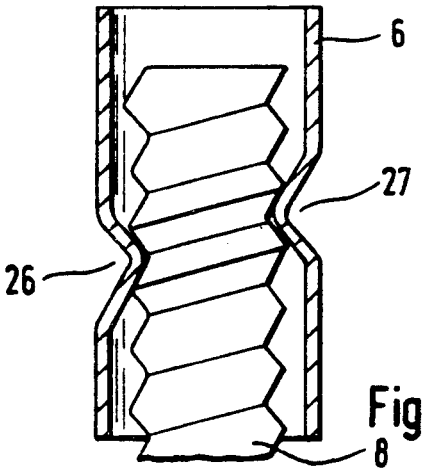
FIG. 13 is a longitudinal section through another embodiment of a contact sleeve.
Figure 12:
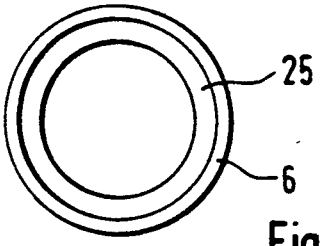
FIG. 12 is a top view of the contact sleeve of FIG. 11.
Figure 14:
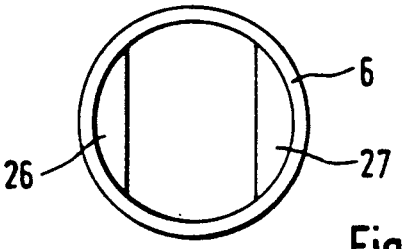
FIG. 14 is a top view of the contact sleeve of FIG. 12.

In the embodiment according to FIGS. 11 and 12, the contact sleeve 6 is provided with a circumferential indentation 25 extending obliquely to the longitudinal axis of the contact sleeve 6. As shown in FIGS. 13 and 14, instead of a circumferential indentation 25, there can, however, also be provided two indentations 26, 27 which extend tangentially to the contact sleeve 6 and are staggered in height corresponding to the pitch of the thread of the attachment screw 8.

Figure 15:
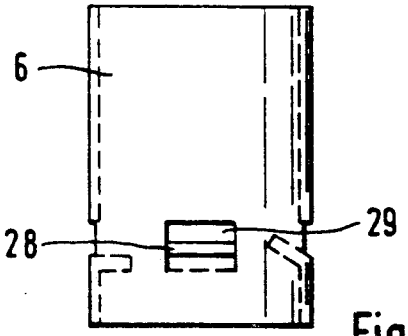
FIG. 15 is a view of another embodiment of a contact sleeve.
Figure 16:
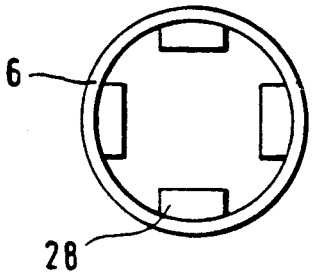
FIG. 16 is a top view of the contact sleeve of FIG. 15.

In accordance with FIGS. 15 and 16 there are provided, as inwardly directed projections, a total of 4 straps 28 which, in the same manner as the sheet-metal tabs 17 of FIG. 3, are in each case formed of a U-shaped cut 29 with bending of the sheet-metal region lying between it.

Figure 17:
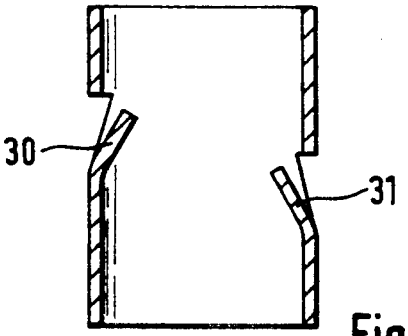
FIG. 17 is a vertical section through a part of another embodiment of a contact sleeve.
Figure 18:
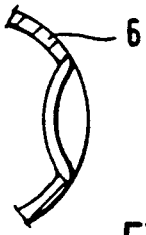
FIG. 18 is a horizontal section through a part of the contact sleeve, of FIG. 17.

The sheet-metal tongues 30, 31 shown in FIGS. 17 and 18 are not bent off at a right angle but rather extend obliquely upward. Furthermore, they are staggered in height.

Figure 19:
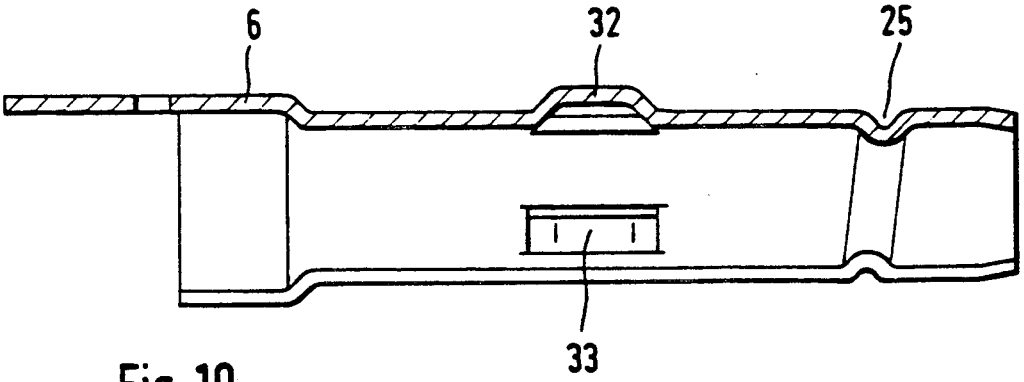
FIG. 19 is another embodiment of a contact sleeve, shown in half section.
Figure 20:
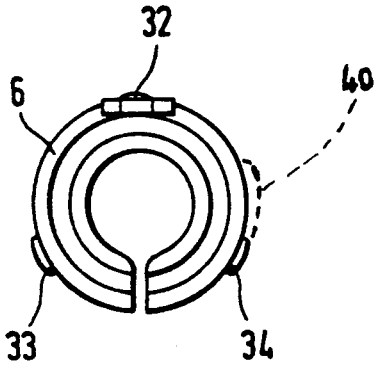
FIG. 20 is a front view of the contact sleeve of FIG. 18.

In the embodiment according to FIGS. 19 and 20, there are provided as twist-preventing means in the outer surface of the contact sleeve 6 three outwardly directed indentations 32, 33, 34 in the outer surface of the contact sleeve 6. The inwardly directed projection is formed, in the same manner as in FIG. 11 by the thread-like indentation 25.

Figure 21:
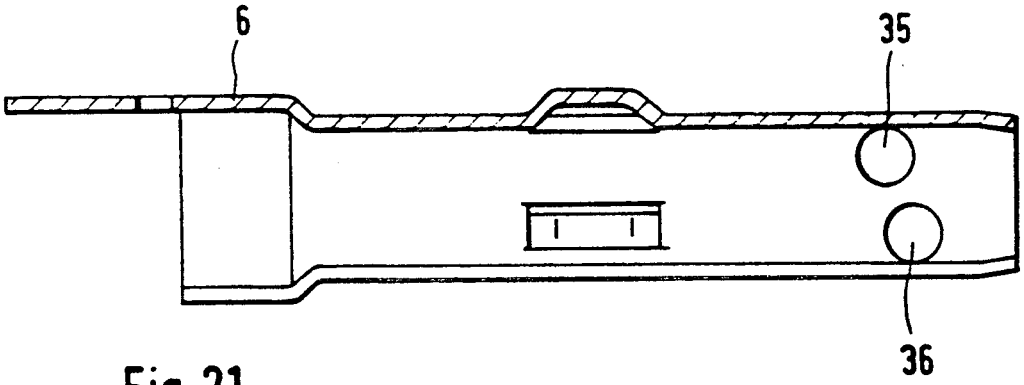
FIG. 21 is another embodiment of a contact sleeve, shown in half section.
Figure 22:
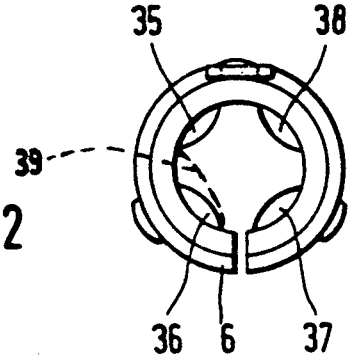
FIG. 22 is a front view of the contact sleeve.

The embodiment according to FIGS. 21 and 22 differs from that of FIGS. 19 and 20 in the manner that instead of the almost circumferential indentation 25 (FIG. 11), there are provided several point-shaped indentations 35, 36, 37, 38 which are staggered in height. Instead of the point-shaped indentations 35–38, elongated individual indentations can also be provided such as the elongated indentation 39 indicated in phantom. Similarly, the outwardly directed indentations 32, 33 and 34 of the twist-preventing means (FIGS. 19 and 20) may be elongated as indicated in phantom by the elongated indentation 40.

I claim:

1. A contact sleeve for installation of a measurement movement to a support element, the sleeve comprising means for receiving an attachment screw with electrical connection to the support element;

wherein the sleeve is a sheet-metal part rolled into a cylinder which has at least one inwardly directed projection to serve as said receiving means for engagement into the thread of the attachment screw; and the sleeve includes a twist-preventing means operative with at least one projection directed radially with respect to an axis of the sleeve.

2. A contact sleeve according to claim 1, wherein said projection of said receiving means is an inwardly directed projection comprising an obliquely extending beading corresponding to the pitch of the thread of the attachment screw, the beading being an oblique end edge of the contact sleeve.

3. A contact sleeve according to claim 2, wherein said twist-preventing means comprises an outwardly directed projection formed by a cut in said sheet-metal part and a lug of said sheet metal part which is bent outwardly out of a contour of said sheet-metal part.

4. A contact sleeve according to claim 1, wherein said twist-preventing means comprises an outwardly directed projection formed by a cut in said sheet-metal part and a lug of said sheet metal part which is bent outwardly out of a contour of said sheet-metal part.

5. A contact sleeve according to claim 4, wherein said lug extends beyond the contour of said sheet-metal part to serve as a detent.

6. A contact sleeve according to claim 1, wherein said receiving means comprises an inwardly directed projection; and said receiving means and said twist-preventing means are formed of a single lug which is first bent outward out of a contour of said sheet-metal part and then bent back inward again beyond an inner contour of said sheet-metal part.

7. A contact sleeve according to claim 6, further comprising a second lug located in said sheet-metal part in diametric opposition to said single lug and staggered in height relative to said single lug corresponding to the pitch of the thread of said attachment screw; and wherein said second lug serves to provide an inwardly directed projection of said receiving means and a part of said twist-preventing means.

8. A contact sleeve according to claim 1, wherein the inwardly directed projection of said receiving means forms an indentation; and said indentation of said receiving means is a circumferential indentation which extends obliquely to an axis of said sleeve corresponding to the pitch of the thread of said attachment screw.

9. A contact sleeve according to claim 1, wherein said inwardly directed projection of said receiving means is formed of two tangential indentations which are staggered in height along an axis of said sleeve corresponding to the pitch of the thread of said attachment screw.

10. A contact sleeve according to claim 1, wherein the inwardly directed projection of said receiving means comprises a tongue which is produced by a U-shaped cut in said sheet-metal part, and is bent obliquely relative to the axis of the sleeve into a contour of said sheet-metal part.

11. A contact sleeve according to claim 1, wherein the inwardly directed projection of said receiving means comprises a point-shaped indentation.

12. A contact sleeve according to claim 1, wherein the inwardly directed projection of said receiving means is an elongated indentation.

13. A contact sleeve according to claim 1, wherein said twist-preventing means comprises a plurality of outwardly directed projections which are each developed as outwardly directed indentations of said sheet-metal part.

14. A contact sleeve according to claim 13, wherein said indentations of said twist-preventing means are elongated.

* * * * *